US010766123B1

(12) United States Patent
Wilson

(10) Patent No.: US 10,766,123 B1
(45) Date of Patent: Sep. 8, 2020

(54) MAGNETIC TOOLS

(71) Applicant: Kevin Wilson, Houston, TX (US)

(72) Inventor: Kevin Wilson, Houston, TX (US)

( * ) Notice: Subject to any disclaimer, the term of this patent is extended or adjusted under 35 U.S.C. 154(b) by 0 days.

(21) Appl. No.: 15/876,141

(22) Filed: Jan. 20, 2018

Related U.S. Application Data

(60) Provisional application No. 62/449,328, filed on Jan. 23, 2017.

(51) Int. Cl.

| | |
|---|---|
| ***B66C 1/04*** | (2006.01) |
| ***H01F 7/20*** | (2006.01) |
| ***B25B 11/00*** | (2006.01) |
| ***B25B 9/00*** | (2006.01) |

(52) U.S. Cl.
CPC ..... *B25B 11/002* (2013.01); *B25B 9/00* (2013.01)

(58) Field of Classification Search
CPC ..... B25B 11/002; B25B 9/00
USPC ..... 294/65.5; 248/206.5; 335/302, 285, 286, 335/287; 209/215
See application file for complete search history.

(56) References Cited

U.S. PATENT DOCUMENTS 1,455,020 A * 5/1923 Collins ..... B25B 9/00 294/104
2,648,434 A * 8/1953 Russell ..... B03C 1/30 209/215
2,654,480 A * 10/1953 Stem ..... A47L 13/41 209/215
2,654,632 A * 10/1953 Herbert ..... B25B 9/00 294/116
2,693,279 A * 11/1954 Box ..... A47L 13/41 209/215
2,709,002 A * 5/1955 Hoff ..... A47L 13/41 209/215
2,954,257 A * 9/1960 Besuch ..... B23Q 3/1546 248/206.5
2,970,003 A * 1/1961 Heath, Jr. ..... A63F 3/062 273/148 R
3,014,751 A * 12/1961 Smith ..... B23Q 3/1546 294/65.5
3,319,989 A * 5/1967 Ross ..... H01F 7/0257 294/65.5
3,343,675 A * 9/1967 Budd ..... A47L 13/41 209/215
4,223,935 A * 9/1980 Rayner ..... B25B 7/12 294/16
4,314,219 A * 2/1982 Haraguchi ..... H01F 7/04 294/65.5
4,588,222 A * 5/1986 Martin ..... B25B 9/00 294/106

(Continued)

FOREIGN PATENT DOCUMENTS

KR 101358045 B1 2/2014

OTHER PUBLICATIONS

Eclipse Magnetic Plate Drag/Grab, https://www.liftinggeardirect.co.uk/eclipse-magnetic-plate-drag.html, Jan. 2018.

*Primary Examiner* — Paul T Chin
(74) *Attorney, Agent, or Firm* — Elliott & Polasek, PLLC; Douglas H. Elliott; Nathan Q. Huynh

(57) ABSTRACT

The disclosure herein include a magnetic tool for attaching to and moving a ferromagnetic workpiece that may include: a chassis having a magnetic face; a base rotatably coupled to the chassis; and a handle rotatably coupled to the base.

13 Claims, 12 Drawing Sheets

(56) References Cited

U.S. PATENT DOCUMENTS

| | | | | | |
|---|---|---|---|---|---|
| 4,662,667 | A * | 5/1987 | Gilligan | G11B 23/00 | 294/104 |
| 5,209,534 | A * | 5/1993 | Crenshaw | A01C 5/02 | 172/22 |
| 5,433,492 | A * | 7/1995 | Glossop, Jr. | B03C 1/284 | 294/65.5 |
| 6,158,792 | A * | 12/2000 | Snider | A47L 13/41 | 209/215 |
| 6,581,737 | B2 * | 6/2003 | Wang | B25B 9/00 | 16/113.1 |
| 6,677,846 | B2 | 1/2004 | Snider | | |
| 6,683,521 | B2 | 1/2004 | Snider | | |
| 6,854,777 | B2 * | 2/2005 | Jung | B66C 1/04 | 294/65.5 |
| 6,976,303 | B2 * | 12/2005 | Chen | B25B 9/00 | 29/729 |
| 8,104,809 | B1 * | 1/2012 | Mayhugh | B25B 11/007 | 248/205.8 |
| 8,544,830 | B2 * | 10/2013 | Sladojevic | B25B 11/002 | 219/205 |
| 8,702,079 | B2 * | 4/2014 | Sladojevic | B25B 11/002 | 249/40 |
| 2002/0105400 | A1 * | 8/2002 | Underwood | B23Q 3/1546 | 335/205 |
| 2007/0131829 | A1 * | 6/2007 | Thompson | B25B 11/002 | 248/206.5 |
| 2011/0180333 | A1 * | 7/2011 | Niederberger | B08B 1/00 | 180/8.6 |

* cited by examiner

MAGNETIC TOOLS

BACKGROUND

1. Field of Inventions

The field of this application and any resulting patent is magnetic tools.

2. Description of Related Art

Various magnetic tools and methods for handling ferromagnetic objects have been proposed and utilized, including some of the methods and structures disclosed in some of the references appearing on the face of this patent. However, those methods and structures lack the combination of steps and/or features of the methods and/or structures covered by the patent claims below. Furthermore, it is contemplated that the methods and/or structures covered by at least some of the claims of this issued patent solve many of the problems that prior art methods and structures have failed to solve. Also, the methods and/or structures covered by at least some of the claims of this patent have benefits that would be surprising and unexpected to a hypothetical person of ordinary skill with knowledge of the prior art existing as of the filing date of this application.

SUMMARY

The disclosure herein includes a magnetic tool for attaching to and moving a ferromagnetic workpiece which tool may include: a chassis having a magnetic face; a base rotatably coupled to the chassis; and a handle rotatably coupled to the base.

The disclosure herein also includes a magnetic tool for attaching to and moving a ferromagnetic workpiece which tool may include: a chassis having a magnetic face; a base rotatably coupled to the chassis; a handle rotatably coupled to the base; and a shield slidably coupled to the chassis and the handle.

The disclosure herein further includes a magnetic assembly for attaching to and moving a ferromagnetic workpiece which assembly may include a magnetic tool that includes: a chassis having a magnetic face; a base rotatably coupled to the chassis; a handle rotatably coupled to the base; and a shield slidably coupled to the magnetic tool.

The disclosure herein additionally includes a magnetic assembly for attaching to and moving a ferromagnetic workpiece which assembly may include a first magnetic tool and a second magnetic tool, each first and second magnetic tool including: a chassis having a magnetic face; a base rotatably coupled to the chassis; and a handle rotatably coupled to the base; and a coupler coupled to each chassis of the magnetic tools.

DETAILED DESCRIPTION

1. Introduction

A detailed description will now be provided. The purpose of this detailed description, which includes the drawings, is to satisfy the statutory requirements of 35 U.S.C. § 112. For example, the detailed description includes a description of the inventions defined by the claims and sufficient information that would enable a person having ordinary skill in the art to make and use the inventions. In the figures, like elements are generally indicated by like reference numerals regardless of the view or figure in which the elements appear. The figures are intended to assist the description and to provide a visual representation of certain aspects of the subject matter described herein. The figures are not all necessarily drawn to scale, nor do they show all the structural details of the systems, nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein are defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in at least one printed publication, dictionary, or issued patent.

2. Selected Definitions

Figure 1A:
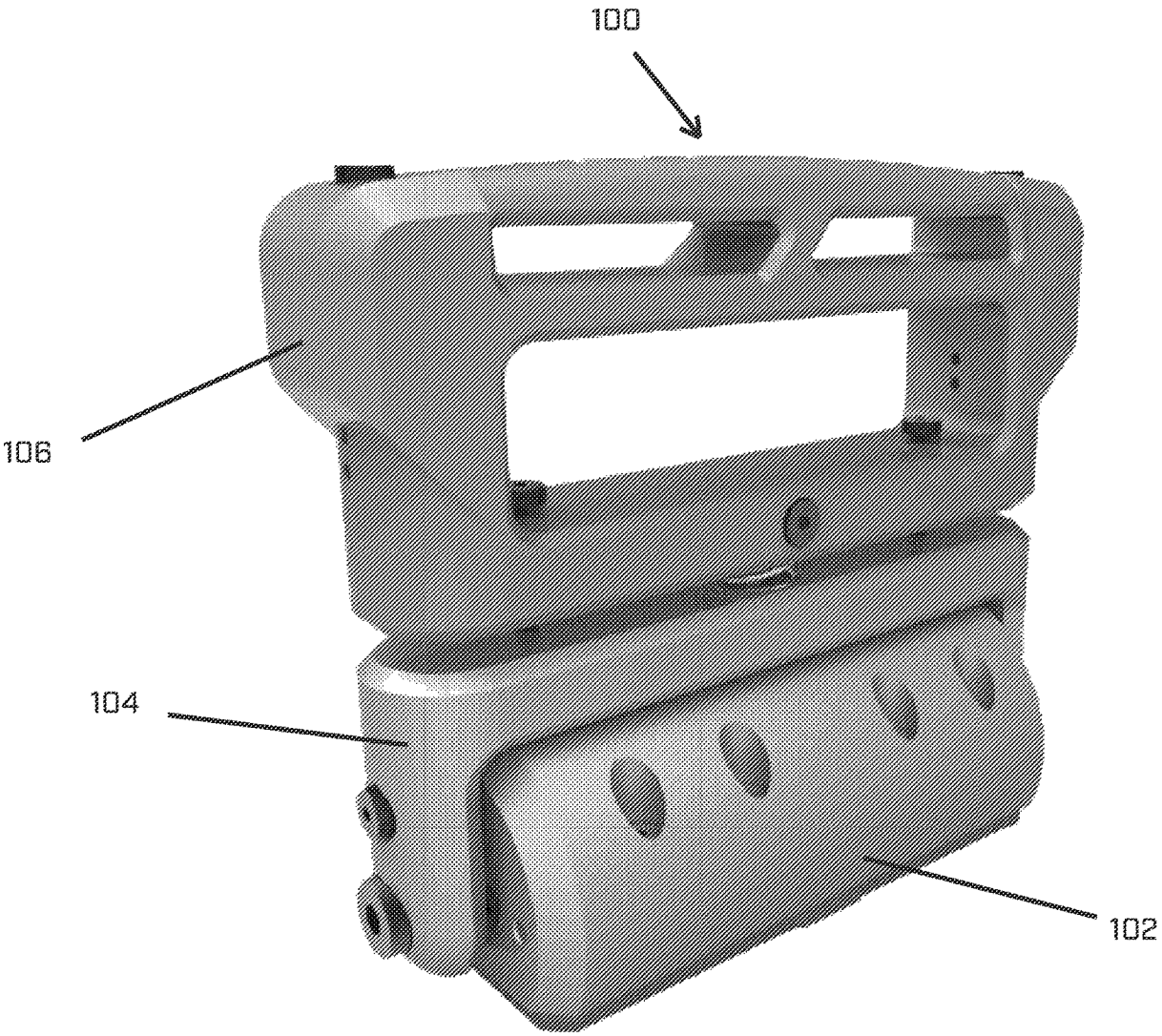
FIG. 1A illustrates a perspective view of an exemplary magnetic tool.

Certain claims include one or more of the following terms which, as used herein, are expressly defined below.

The term "abutted against" as used herein is defined as being positioned adjacent to and either physically touching or pressing against, directly or indirectly. For example, a first object may be abutted against a second object such that the second object is limited from moving in a direction of the first object. For example, a face of a chassis may be abutted against a portion of a shield.

The term "adjacent" as used herein is defined as next to and may include physical contact, but does not require physical contact.

The term "aligned" as used herein is defined as manufactured, formed, or adjusted in a line; or positioned in relation to something else. For example, apertures disposed in two different structures may be aligned so that an imaginary line can pass through both apertures. For example, an elongated member such as a bolt or screw may be capable of passing through both an aperture in one structure and also a different aperture in an adjacent structure and thus be capable of positioning both structures as desired.

The term "aperture" as used herein is defined as any opening in a solid object or structure. For example, an aperture may be an opening that begins on one side of the solid object and ends on the other side of the object. An aperture may alternatively be an opening that does not pass entirely through the object, but only partially passes through, e.g., as a groove. An aperture can be an opening in an object that is completely circumscribed, defined, or delimited by the object itself. Alternatively, an aperture can be an opening in the object when the object is combined with one or more other objects or structures. One or more apertures may be disposed and passed entirely through a chassis, base, handle, bearing, washer, and spacer. An aperture may receive another object and permit ingress and/or egress of the object through the aperture.

The term "coupled" as used herein is defined as directly or indirectly connected, attached, or integral with, e.g., part of. A first object may be coupled to a second object such that the first object is positioned at a specific location and orientation with respect to the second object. A first object may be either permanently or removably coupled to a second object. Two objects may be permanently coupled to each other via adhesive, welding, or mechanically pressed together; or they may be removably coupled via nails, screws, or nuts and bolts. Also, two objects may be capable of being threadably coupled together, e.g., where a threaded outer surface of one object is capable of engaging with or to a threaded inner surface of another object. Thus, a threaded assembly may be threadably coupled to a threaded portion of a base, chassis, and/or handle.

The term "cylindrical" as used herein is defined as shaped like a cylinder, e.g., the shape of a structure having straight parallel sides and a circular or oval or elliptical cross-section. A cylindrical body or structure, e.g., chassis, may be completely or partially shaped like a cylinder. A chassis is an example of a solid cylindrical body.

The term "threaded assembly" as used herein refers to an assembly that includes threads, and preferably also includes one or more bolts, one or more springs, one or more washers, and/or one or more spacers used for coupling two objects together. A bolt and a washer may, for example, share a common central axis line. Also, a bolt and a spring may share a common central axis line.

The term "threaded" as used herein is defined as having threads. Threads may include one or more helical protrusions or grooves on a surface of a cylindrical object. Each full rotation of a protrusion or groove around a threaded surface of the object is referred to herein as a single "thread." A bolt may include a "threaded portion" wherein a section of the bolt includes threads. A threaded portion may be threadably mated with a "box thread" disposed in a chassis, base, or handle.

The term "exemplary" is used exclusively herein to mean "serving as an example, instance, or illustration." Anything, including any embodiment, structure, element, or step, described herein as exemplary, is not to be construed as preferred or advantageous over other embodiments, structures, elements, steps, etc.

3. Certain Specific Embodiments

The disclosure herein includes a magnetic tool for attaching to and moving a ferromagnetic workpiece which tool may include: a chassis having a magnetic face; a base rotatably coupled to the chassis; and a handle rotatably coupled to the base.

The disclosure herein includes a magnetic tool for attaching to and moving a ferromagnetic workpiece which tool may include: a chassis having a magnetic face; a base rotatably coupled to the chassis; a handle rotatably coupled to the base; and a shield slidably coupled to the chassis and the handle.

The disclosure herein includes a magnetic assembly for attaching to and moving a ferromagnetic workpiece which assembly may include: a magnetic tool including: a chassis having a magnetic face; a base rotatably coupled to the chassis; and a handle rotatably coupled to the base; and a shield slidably coupled to the magnetic tool.

The disclosure herein includes a magnetic assembly for attaching to and moving a ferromagnetic workpiece which assembly may include: a first magnetic tool and a second magnetic tool, each magnetic tool including: a chassis having a magnetic face; a base rotatably coupled to the chassis; and a handle rotatably coupled to the base; and a coupler coupled to each chassis of the magnetic tools.

In any one of the methods or structures disclosed herein, a rotation axis of the base relative to the chassis may be orthogonal to a rotation axis of the handle relative to the base.

In any one of the methods or structures disclosed herein, the magnetic face of the chassis may include an aperture for receiving a magnet.

In any one of the methods or structures disclosed herein, the base may be rotatably coupled to opposing ends of the chassis.

Any one of the methods or structures disclosed herein may further include a threaded assembly extended through the chassis and the base.

Any one of the methods or structures disclosed herein may further include a threaded assembly extended through the base and the handle.

In any one of the methods or structures disclosed herein, the chassis and the base may further include apertures that are aligned for receiving a pin.

Any one of the methods or structures disclosed herein may further include a pin extendable through the chassis and the base for preventing the base from rotating relative to the chassis.

In any one of the methods or structures disclosed herein, the base and the handle may further include apertures that are aligned for receiving a pin.

Any one of the methods or structures disclosed herein may further include a pin extendable through the base and the handle for preventing the handle from rotating relative to the base.

Any one of the methods or structures disclosed herein may further include a threaded assembly extended through the chassis and the shield, the threaded assembly slidable along a portion of the shield.

Any one of the methods or structures disclosed herein may further include a threaded assembly including: a spring positioned between the shield and the handle; and a pin extended through the shield, the handle, and the spring.

In any one of the methods or structures disclosed herein may further include: a first threaded assembly extended through the coupler and the chassis of the first magnetic tool; and a second threaded assembly extended through the coupler and the chassis of the second magnetic tool.

In any one of the methods or structures disclosed herein, wherein the coupler may be solid.

In any one of the methods or structures disclosed herein, the coupler may be a wall.

In any one of the methods or structures disclosed herein, the coupler may be a triangular prism.

In any one of the methods or structures disclosed herein, the coupler may a rectangular prism.

In any one of the methods or structures disclosed herein, the magnetic faces of the magnetic tools may be coplanar.

4. Specific Embodiments in the Drawings

The drawings presented herein are for illustrative purposes only and do not limit the scope of the claims. Rather, the drawings are intended to help enable one having ordinary skill in the art to make and use the claimed inventions.

This section addresses specific versions of magnetic tools shown in the drawings, which relate to assemblies, elements and parts that can be part of a magnetic tool and/or magnetic assembly, and methods for operating (using) such magnetic tools and magnetic assemblies. Although this section focuses on the drawings herein, and the specific embodiments found in those drawings, parts of this section may also have applicability to other embodiments not shown in the drawings. The limitations referenced in this section should not be used to limit the scope of the claims themselves, which have broader applicability.

Although the methods, structures, elements, and parts described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims, while the description, abstract and drawings are not to be used to limit the scope of the invention. The invention is specifically intended to be as broad as the claims below and their equivalents.

Described herein is a system that is intended for the use of moving, handling, transferring or orienting a workpiece and which may have other as yet undefined applications. The system consists of three major elements that can be used in tandem or separately as a task requires.

Element One may be a magnetic handling device (MHD) which comprises or consists of the following parts: a magnet or cluster of magnets; an articulating base that allows rotation of the above magnetic cluster about a major axis; a handle, grip or other interface that, when attached to the base, allow for rotation about an axis that is transverse to that of the previously defined articulating base.

Element Two may be a coupler attachment which, when attached to the magnetic clusters or any other part of the independent MHDs as defined above, ties two or more MHDs together to form a single lifting unit.

Element Three may be a partially or fully enveloping attachment which allows for Element One to move about an axis perpendicular to the workpiece, thereby enabling disengagement of the magnetic field from the workpiece as desired. Distinguishing features relative to known prior art include the following. The ability for the MHD to rotate in two axes relative to the workpiece, thereby allowing optimal wrist position and reduced operator fatigue. The ability to lock rotation of the handle, grip or other interface relative to the articulating base. The ability to lock rotation of the articulating base relative to the magnetic cluster. The ability to couple multiple MHDs into one device using Element Two to increase lifting capacity. The ability of the MHD to selectively engage and disengage the magnetic field from the workpiece when used in tandem with Element Three. The ability of the MHD to be engaged with hands, a lifting sling/cable or hook. The integration of an adjustment key for assembly, maintenance and operation.

FIG. 1A illustrates a perspective view of an exemplary magnetic tool 100. The magnetic tool 100 includes a chassis 102, a base 104, and a handle 106. The base 104 may be rotatably coupled to the chassis 102.

Figure 1B:
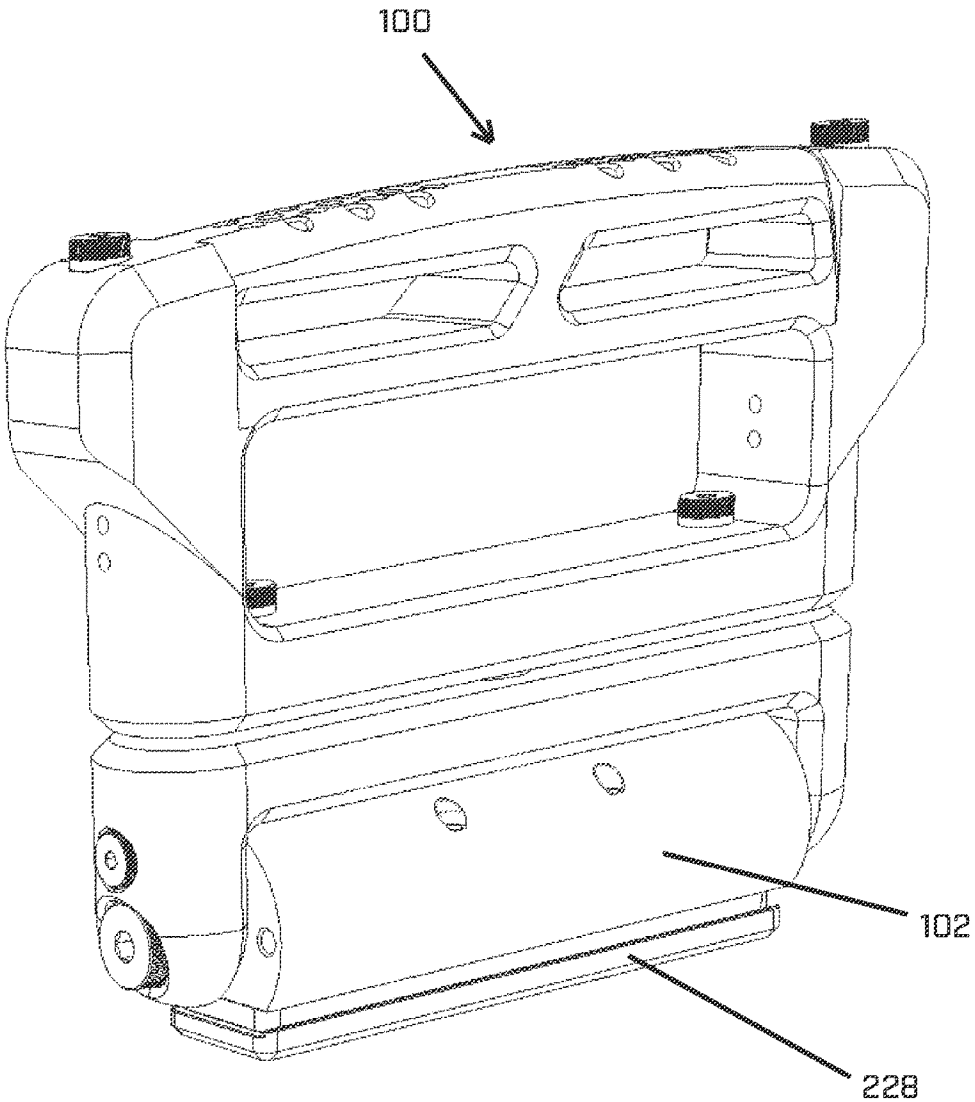
FIG. 1B illustrates a perspective view of an exemplary magnetic tool including a shield.

FIG. 1B illustrates a perspective view of a magnetic tool 100 including a shield 228. The shield 228 may be removably coupled the chassis 102.

Figure 2:
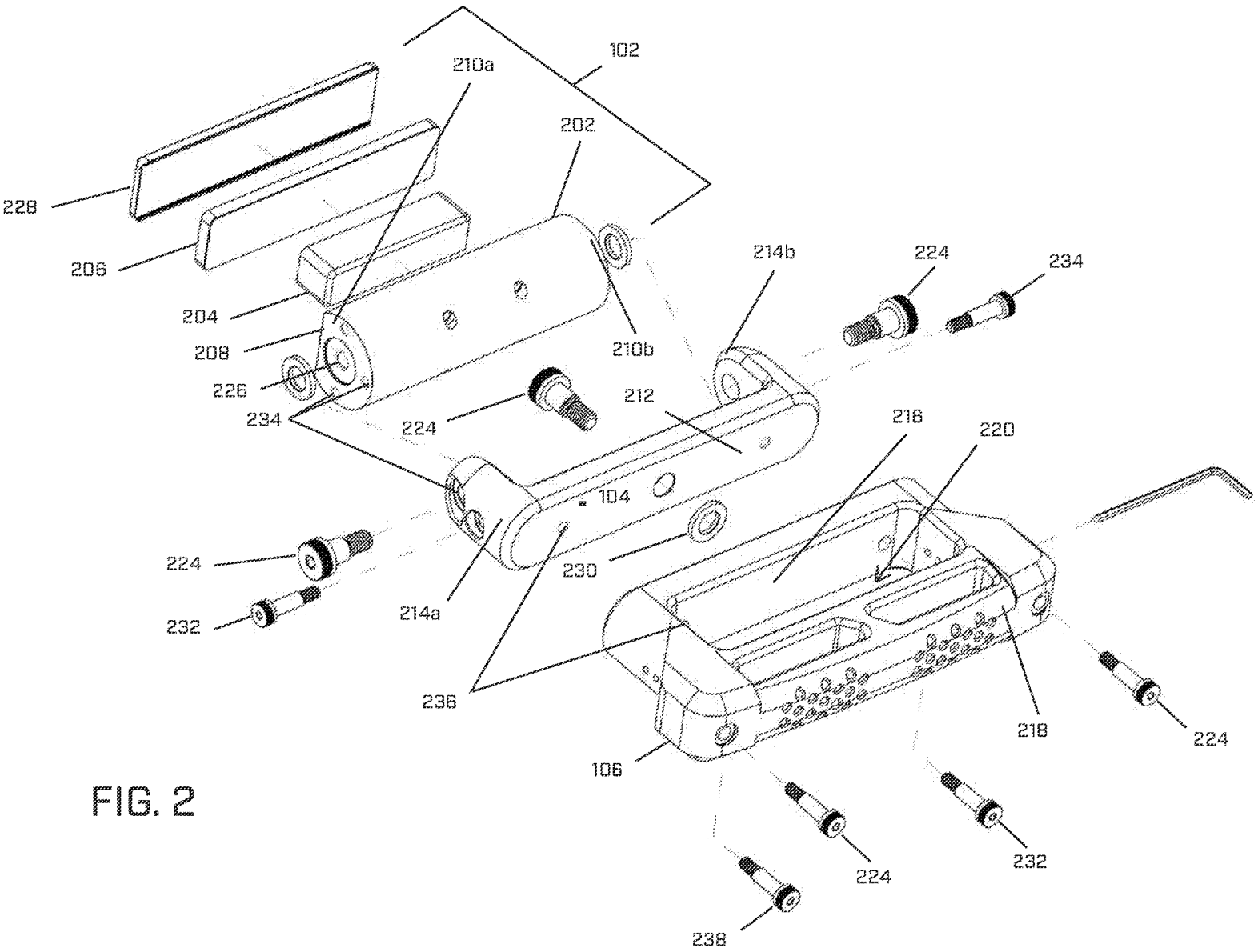
FIG. 2 illustrates an exploded view of a magnetic tool.

FIG. 2 illustrates an exploded view of a magnetic tool 100. The chassis 102 may have a generally cylindrical body 202 with two opposing ends 210*a*, 210*b*. A face 208 may be disposed on the body 202. A groove (not shown) may be disposed in the face 208. A magnet 204 may be disposed within the groove. A first cover 206 may be disposed in the groove over the magnet 204. The first cover 206 may be removably coupled to the body 202 via one or more threaded assemblies (not shown) extended through the first cover 206 and the body 202.

In some case, a shield 228 may be disposed over the face 208 for providing protection to the face 208 when the magnetic tool 100 is not in use. Preferably, the shield 228 has a metallic portion that for attraction to the magnet 204 and may be retained against the body 202, as shown in FIG. 1B. Additionally, the shield 228 may have a nonmagnetic portion for preventing magnetic forces to extend past the shield 228.

The base 104 may be a structure having an elongated portion 212. Two end portions 214*a*, 214*b* may extend from opposing ends of the elongated portion 212, as shown in FIG. 2. Preferably, the two end portions 214*a*, 214*b* is extended at ninety (90) degrees from the elongated portion 212, to form a C-shape or a D-shape. Each end portion 214 may be rotatably coupled to a respective end 210 of the chassis 102. Additionally, a threaded assembly 224 may be extended through each end portion 214 and each respective end 210 of the chassis 102. Each threaded assembly 224 may have a threaded portion for threadable mating with a box thread 226 disposed at each end 210 of the chassis 102. Thus, the base 104 is capable of being rotated on an axis around the chassis 102.

Still referring to FIG. 2, the handle 106 may be a D-shaped structure. Preferably, an aperture 220 may be disposed in the handle 106 to define a lower portion 216 and an upper portion 218. The aperture 220 may receive an object, e.g., human hand, strap, clip, and/or hook, for grasping, hooking, and/or attaching to the upper portion 218. Also, one or more apertures 222 may be disposed in the upper portion 218 of the handle 106. Each aperture 222 may receive an object, e.g., strap, clip, and/or hook, for grasping, hooking, and/or attaching to the upper portion 218.

A threaded assembly having a bolt 224 and a washer 230 may be provided for rotatable coupling of the elongated portion 212 of the base 104 to the lower portion 216 of handle 106. The washer 230 may be disposed between the elongated portion 212 and the lower portion 216. The bolt 224 may be extended through the elongated portion 212, the washer 230, and the lower portion 216. Also, the bolt 224 may have a threaded portion for threadable mating with a box thread (not shown) disposed in the handle 106.

Preferably, the elongated portion 212 of the base 104 and the lower portion 216 of the handle 106 are parallel to each other so that, in some cases, they do not touch. Thus, the handle 106 is capable of rotating on an axis relative to the base 104. Additionally, the axis of rotation of the handle 106 may be orthogonal, i.e., perpendicular, at a right angle, transverse, or at 90 degrees, to the axis rotation of the base 104 around the chassis 102. Also, the handle 106 may be rotated independently of any rotation applied to the base 104. Alternatively, the base 104 may be rotated independently of any rotation applied to the handle 106.

Still referring to FIG. 2, apertures 234 may be disposed in each end 210 of the chassis 102 and each end portion 214 of the base 104. The apertures 234 of the respective end 210 and the end portion 214 may be aligned. For example, the apertures 234 of the end 210*a* of the chassis 102 and the end portion 214*a* of the base 104 may be aligned to receive a pin 232 there through. Likewise, the apertures (not shown) of the end 210*b* of the chassis 102 and the end portion 214*b* of the base 104 may be aligned to receive a pin 232 there through. A pin 232 that is extended through the respective apertures 234 of the ends 210 of the chassis 102 and the end portion 214 of the base 104 may prevent the base 104 from being rotated relative to the chassis 102.

Additionally, apertures 236 may be disposed in the base 104 and the handle 106. The apertures 236 of the base 104 and the handle 106 may be aligned to receive a pin 238. A pin 238 that is extended through the apertures 234 may prevent the handle 106 from being rotated relative to the base 102.

Figure 3:
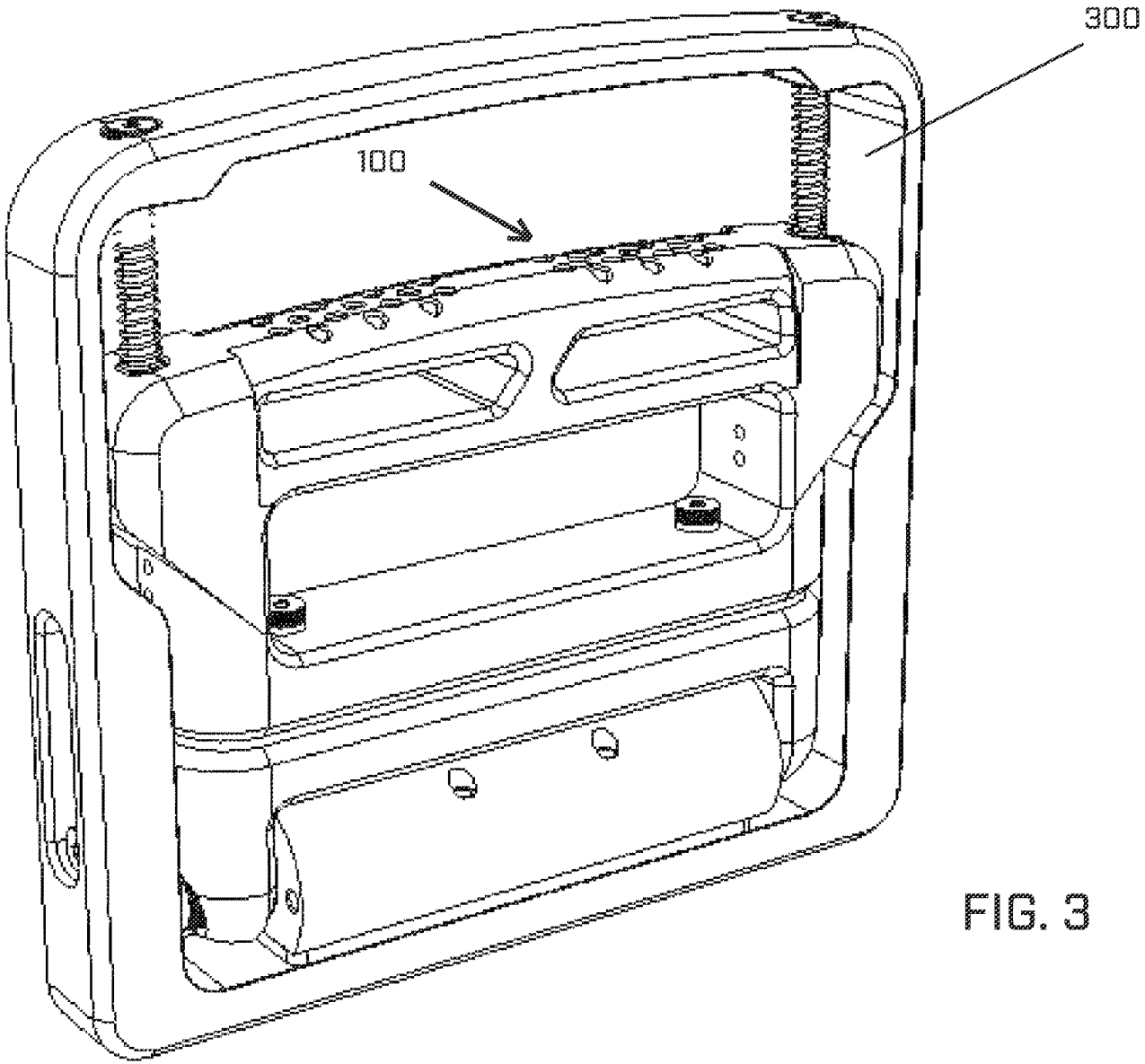
FIG. 3 illustrates a perspective view of a magnetic tool coupled to a shield.

FIG. 3 illustrates a perspective view of a magnetic tool 100 coupled to a shield 300. The magnetic tool 100 and the shield 300 may share a central plane. Additionally, the face 208 of the chassis 102 may be positioned adjacent to or abutted against a lower portion of the shield 300.

Figure 4:
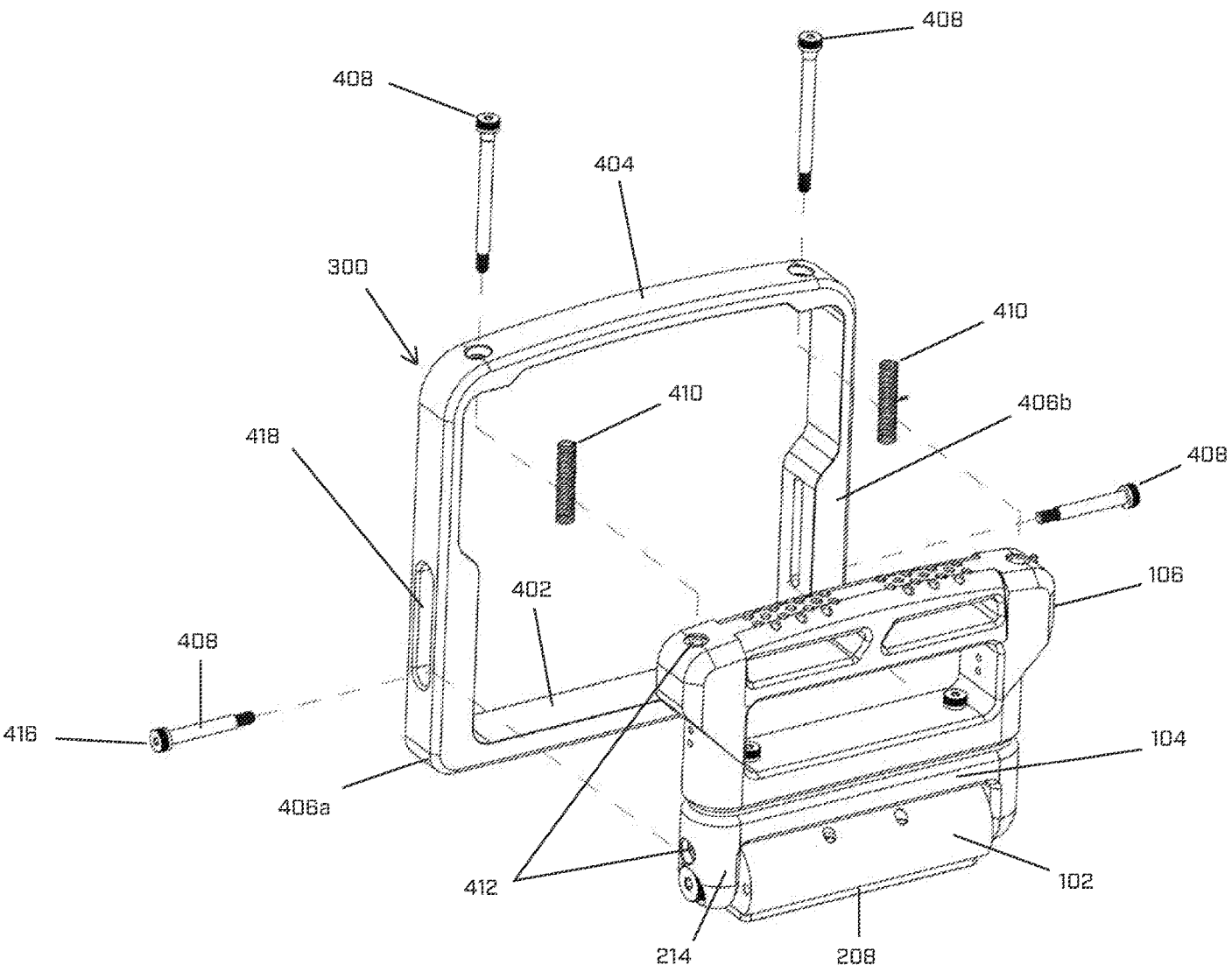
FIG. 4 illustrates an exploded view of a magnetic assembly having a magnetic tool and a shield.

FIG. 4 illustrates an exploded view of a magnetic assembly having a magnetic tool 100 and a shield 300. The shield 300 may have a lower portion 402, an upper portion 404, and side portions 406*a*, 406*b*. Preferably, the portions 402-406 may form a rectangular or D-shape. A threaded assembly including a bolt 408 and a spring 410 may be provided for slidable coupling of the upper portion 404 of the shield 300 to the upper portion 218 of the handle 106. The spring 410 may be positioned between the upper portions 404, 218. The bolt 408 may extend through the upper portion 404 of the shield 300, the spring 410, and the upper portion 218 of the handle 106. Additionally, the bolt 408 may include a threaded portion for threadable mating with a box thread 412 disposed in the upper portion 218 of the handle 106.

Additionally, a threaded assembly including a bolt 408 may be provided for slidable coupling of the side portions 406*a*, 406*b* of the shield 300 to the respective side portions 214*a*, 214*b* of the base 104. Each bolt 408 may be extended through a groove 418 disposed in each side portion 406. A portion 416 of the bolt 408 may be retained in the groove 418 such that the portion 416 may be slid along the length of the groove 418. Furthermore, each bolt 408 may include a threaded portion for threadable mating with a box thread 412 disposed in a side portion 214 of the base 104.

The face 208 of the chassis 104 may be positioned adjacent to the lower portion 402 (FIG. 3).

In lifting operations, an operator may position the magnetic tool 100 within a distance, e.g., over, near to, adjacent to, onto, or abutted against, one or more ferromagnetic objects (not shown), e.g. nails, screws, plates, and debris. The magnetic forces from the magnet (FIG. 2) in the chassis 104 may extend through the lower portion 402 of the shield 300 to attract the one or more ferromagnetic objects against the lower portion 402.

In release operations, the operator may grasp the upper portion 404 of the shield 300 and upper portion 218 of the handle 106. Further, the operator may displace the chassis 104 away from the lower portion 402 of the shield 300 by clenching a fist and drawing the upper portions 404, 218 towards each other. Greater displacement of the chassis 104 from the lower portion 402 may diminish the attraction between the magnet and the ferromagnetic objects so that the shield 300 may be separated from the ferromagnetic objects.

The operator may release the handle 104 to return the chassis 102 to its original position against the lower portion 402 of the shield 300. The lift and release operations describe above may be repeated with various ferromagnetic objects.

Figure 5:
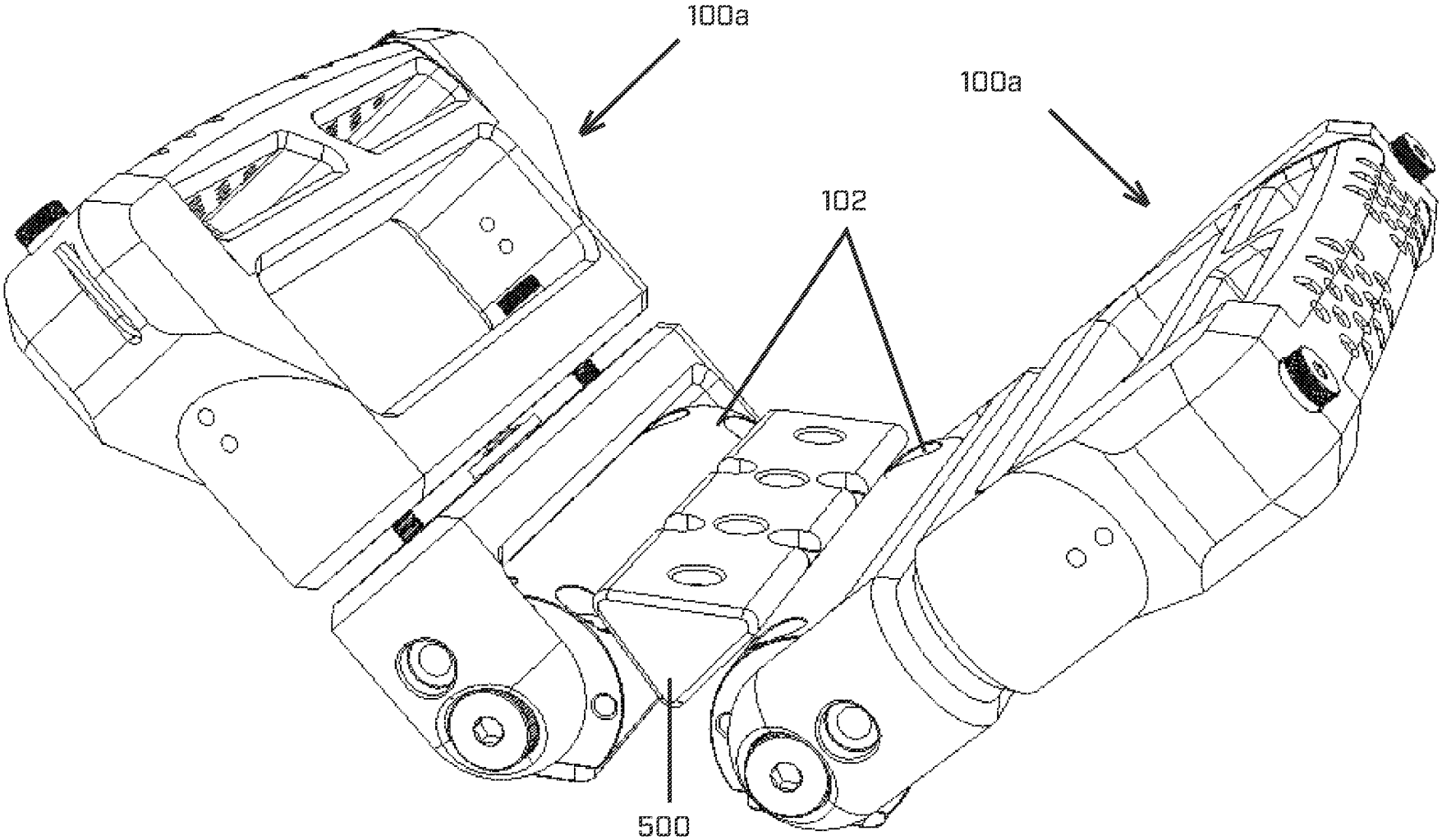
FIG. 5 illustrates a perspective view of a magnetic assembly having two magnetic tools coupled together.

FIG. 5 illustrates a perspective view of a magnetic assembly having two magnetic tools 100*a*, 100*b* coupled together. A coupler 500 may be coupled to each chassis 102 of each magnetic tool 100.

Figure 6:
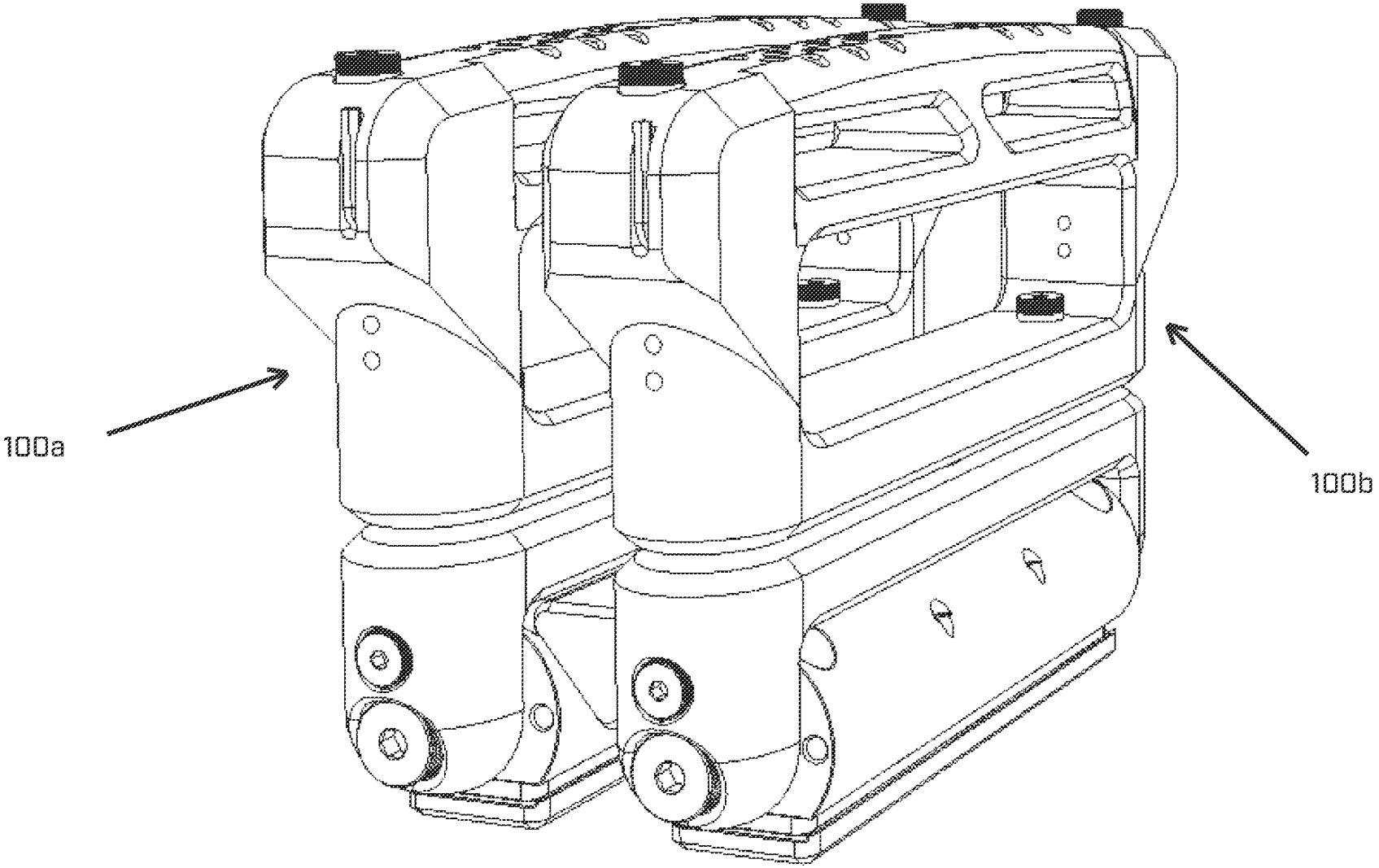
FIG. 6 illustrates a perspective view of a magnetic assembly having two magnetic tools coupled together and positioned parallel to each other.

FIG. 6 illustrates a perspective view of a magnetic assembly having two magnetic tools 100*a*, 100*b* coupled together and positioned parallel to each other. The faces of the chassis of the magnetic tools 100*a*, 100*b* are preferably coplanar. Also, each magnetic tool 100 may be rotated relative to its respective chassis. Additionally, each magnetic tool 100 may be rotated independently of the other. Thus, the magnetic tools 100*a*, 100*b* may be rotated away or towards each other to form an angle, as shown in FIG. 5. Alternatively, the magnetic tools 100*a*, 100*b* may be rotated and positioned parallel to each other, as shown in FIG. 6.

Figure 7:
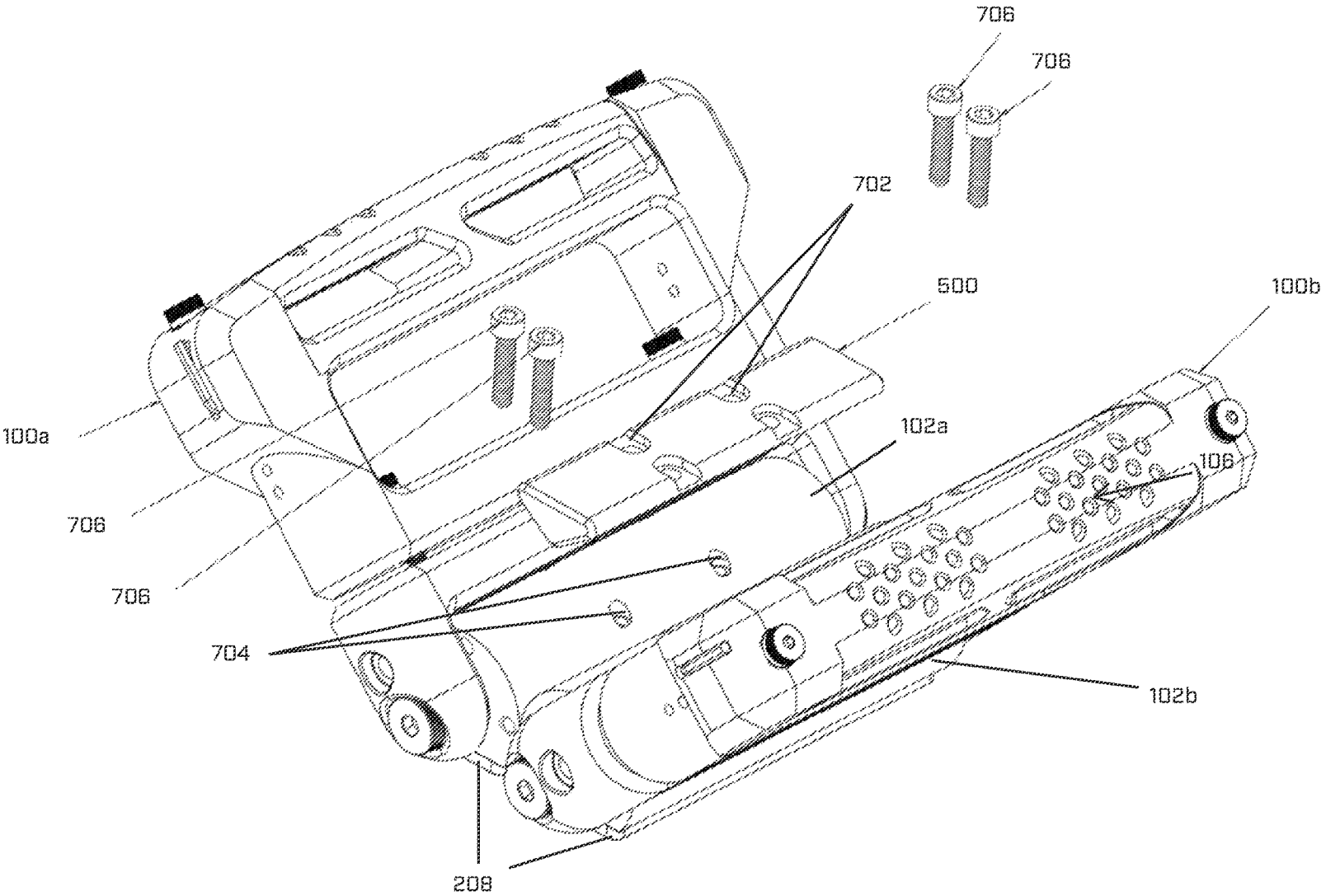
FIG. 7 illustrates an exploded view of a coupler for coupling two magnetic tools of a magnetic assembly.
Figure 11:
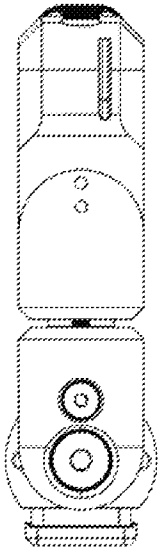
FIG. 11 illustrates a second side view of a magnetic tool having a slot to store an adjustment tool.
Figure 8:
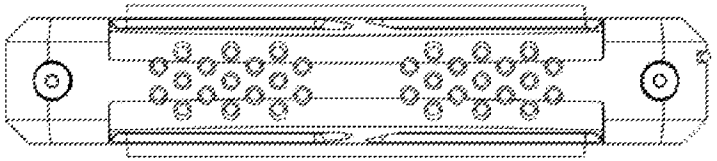
FIG. 8 illustrates a top view of a handle of a magnetic tool.
Figure 9:
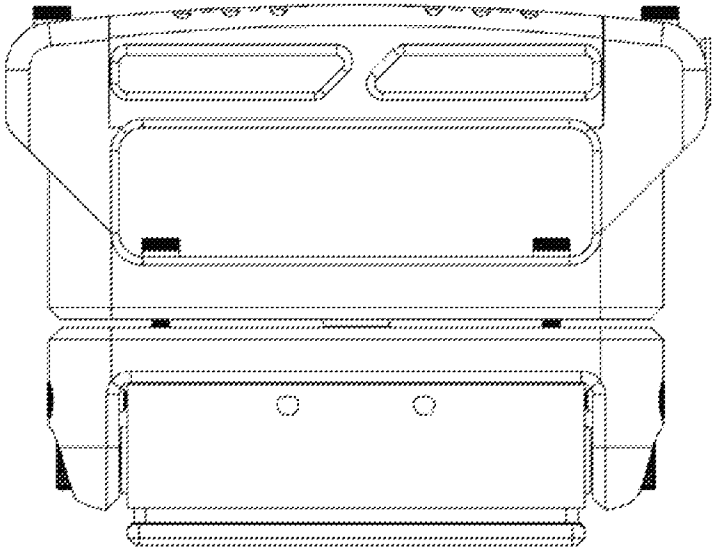
FIG. 9 illustrates a frontal view of a magnetic tool.
Figure 12:
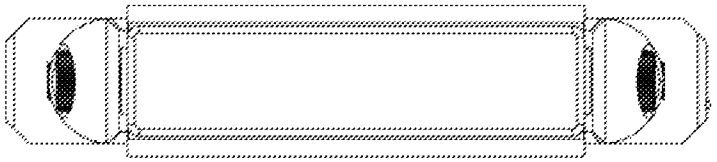
FIG. 12 illustrates a bottom view of a chassis and base of a magnetic tool.
Figure 10:
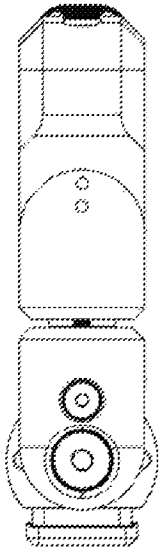
FIG. 10 illustrates a first side view of a magnetic tool.
Figure 13:
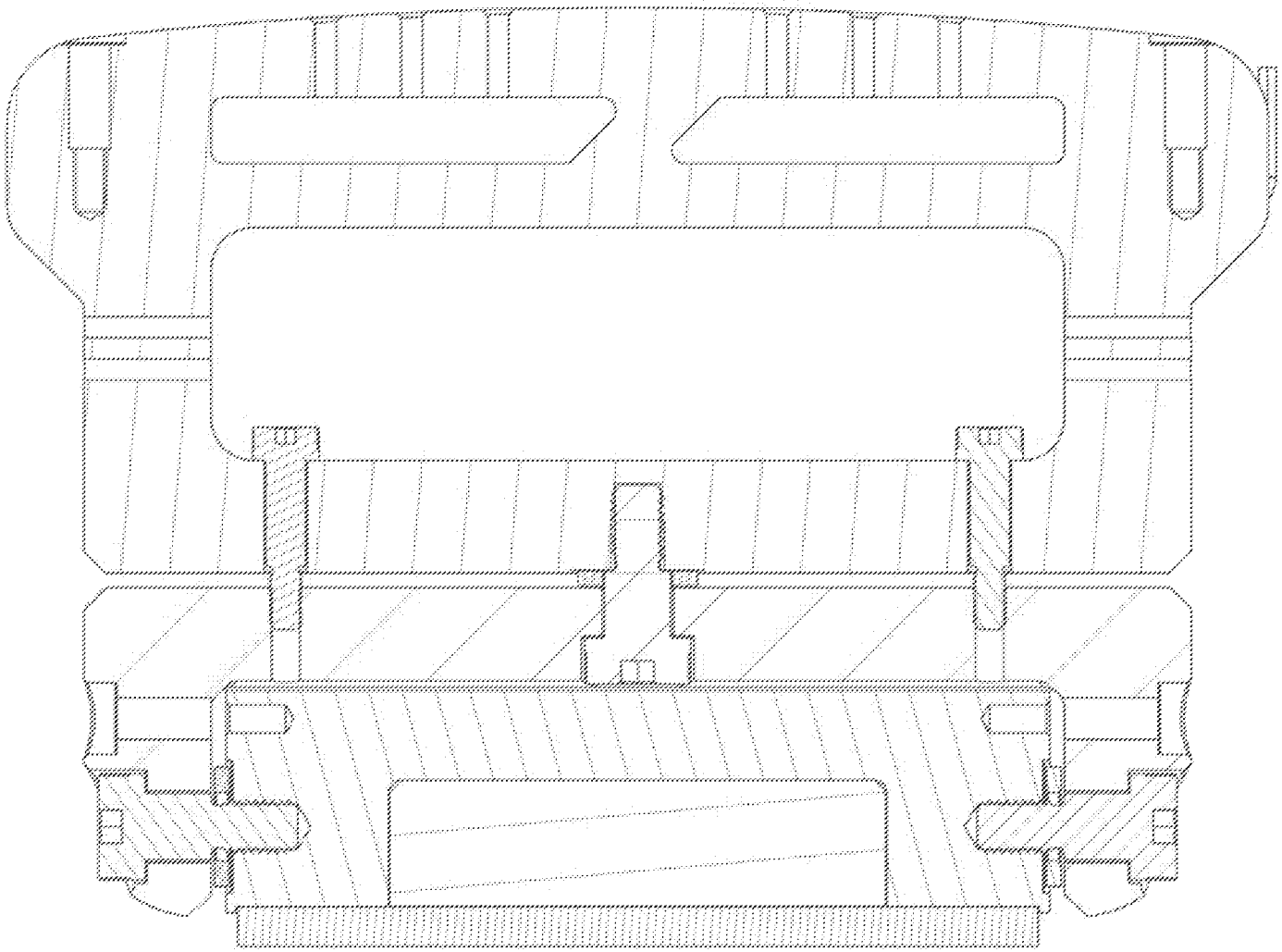
FIG. 13 illustrates a cross-sectional frontal view of a magnetic tool.
Figure 14:
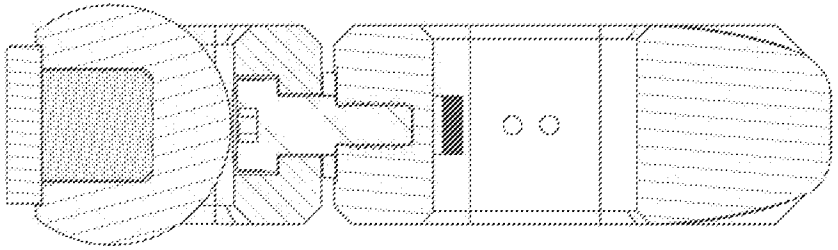
FIG. 14 illustrates a cross-sectional side view of a magnetic tool.

FIG. 7 illustrates an exploded view of a coupler 500 for coupling two magnetic tools 100*a*, 100*b* of a magnetic assembly. The coupler 500 may be a solid structure. Additionally, the coupler 500 may be a wall. Also, the coupler 500 may be a triangular prism. Furthermore, the coupler 500 may be a rectangular prism.

The coupler 500 may be positioned adjacent to and/or between the chassis 102*a*, 102*b*. The chassis 102*, 102*b* may also be adjacent to each other such that their faces 208 are coplanar.

The coupler 500 and the chassis 102*a*, 102*b* may be coupled via threaded assemblies that include a bolt 706. The coupler 500 may include one or more apertures 702 that are aligned with box threads 704 disposed in each chassis 102. Each bolt 706 may be extended through an aperture 702 of the coupler 500. Also, each bolt 706 may include a threaded portion for threadable mating with a box thread 704.

FIGS. 8-14 illustrate additional views of examples of a magnetic tool 100.

Figure 16:
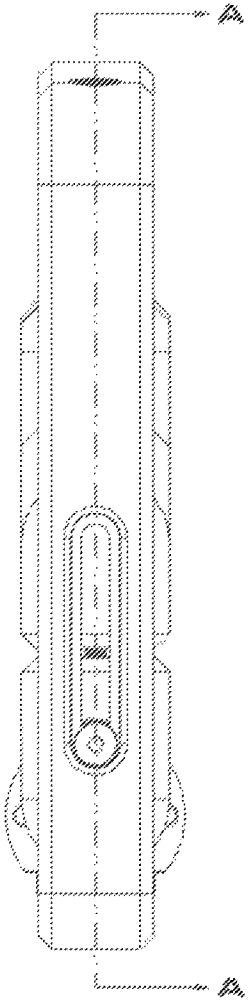
FIG. 16 illustrates a side view of a magnetic assembly having a magnetic tool coupled to a shield.
Figure 15:
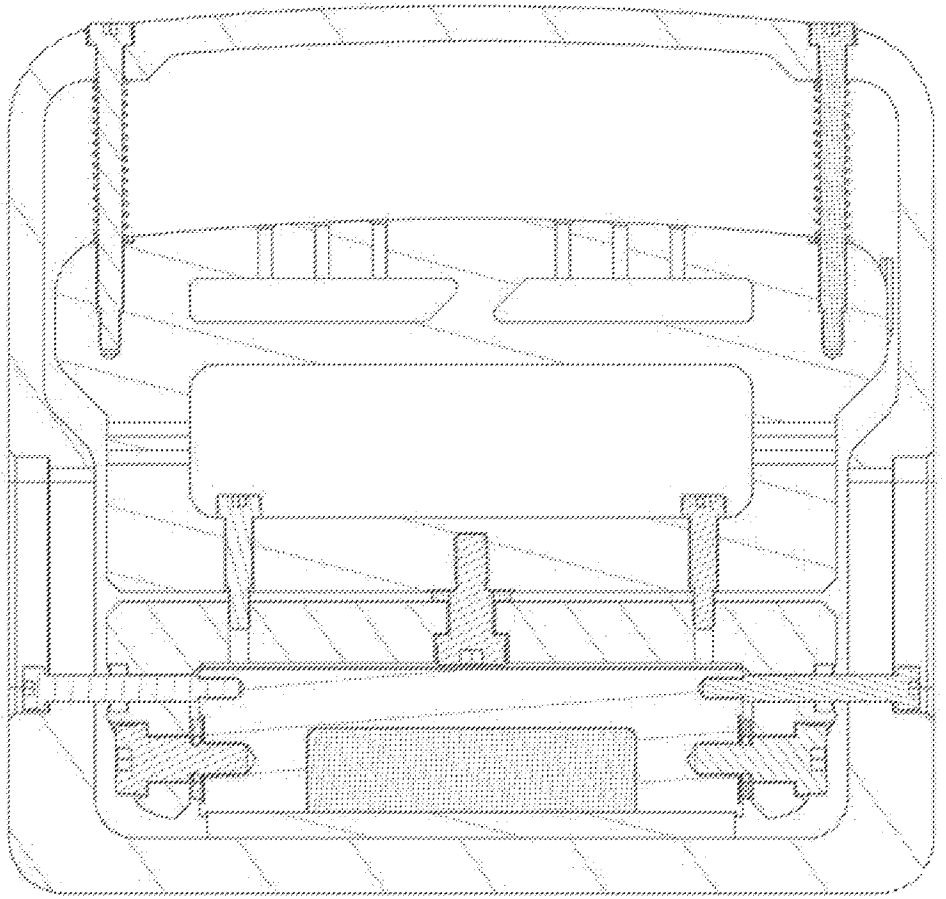
FIG. 15 illustrates a cross-sectional frontal view of magnetic assembly having a magnetic tool and a shield.

FIGS. 15-16 illustrate additional views of examples of a magnetic assembly having of a magnetic tool 100 coupled to a shield 300.

What is claimed as the invention is:

1. A magnetic tool for attaching to and moving a ferromagnetic workpiece, comprising:

a chassis having a magnetic face having an aperture for receiving a magnet;

a base rotatably coupled to the chassis;

a handle rotatably coupled to the base, wherein a rotation axis of the base relative to the chassis is orthogonal to a rotation axis of the handle relative to the base; and a coupler capable of being removably coupled to the chassis and to another chassis of another magnetic tool.

2. The magnetic tool of claim 1, wherein the coupler is disposed between ends of the chassis.

3. The magnetic tool of claim 1, wherein the coupler is solid.

4. The magnetic tool of claim 1, wherein the coupler is a wall.

5. The magnetic tool of claim 1, wherein the coupler is a triangular prism.

6. The magnetic tool of claim 1, wherein the coupler is a rectangular prism.

7. The magnetic tool of claim 1, further comprising a shield slidably coupled to the chassis.

8. The magnetic tool of claim 1, further comprising a shield slidably coupled to the chassis and the handle.

9. The magnetic tool of claim 1, further comprising a shield disposed around the chassis, the base, and the handle.

10. The magnetic tool of claim 1, further comprising a shield having a portion biased against the magnet.

11. The magnetic tool of claim 1, wherein the magnetic tool and the shield share a central plane.

12. The magnetic tool of claim 1, further comprising:

a shield;

a spring positioned between the shield and the handle.

13. The magnetic tool of claim 1, further comprising:

a shield;

a spring positioned between the shield and the handle; and a pin extending through the shield, the spring, and the handle.

* * * * *